US011338965B2

(12) United States Patent
Jowett et al.

(10) Patent No.: US 11,338,965 B2
(45) Date of Patent: May 24, 2022

(54) OR RELATING TO LID ARRANGEMENTS

(71) Applicant: LOADHOG LIMITED, Sheffield (GB)

(72) Inventors: Leigh Jowett, Sheffield (GB); Luke Davis, Sheffield (GB)

(73) Assignee: LOADHOG LIMITED

( * ) Notice: Subject to any disclaimer, the term of this patent is extended or adjusted under 35 U.S.C. 154(b) by 177 days.

(21) Appl. No.: 16/615,711

(22) PCT Filed: Jun. 28, 2018

(86) PCT No.: PCT/GB2018/000100
§ 371 (c)(1),
(2) Date: Nov. 21, 2019

(87) PCT Pub. No.: WO2019/002804
PCT Pub. Date: Jan. 3, 2019

(65) Prior Publication Data

US 2020/0172301 A1 Jun. 4, 2020

(30) Foreign Application Priority Data

Jun. 29, 2017 (GB) ..... 1710462
Jun. 27, 2018 (GB) ..... 1810524

(51) Int. Cl.
*B65D 43/16* (2006.01)
*B65D 21/06* (2006.01)

(52) U.S. Cl.
CPC ..... *B65D 43/165* (2013.01); *B65D 21/064* (2013.01)

(58) Field of Classification Search
CPC .... B65D 21/06; B65D 21/062; B65D 43/163; B65D 43/162; B65D 43/161; B65D 43/16;
(Continued)

(56) References Cited

U.S. PATENT DOCUMENTS 3,463,345 A * 8/1969 Bockenstette ..... B65D 43/165 220/826
3,655,088 A * 4/1972 Box ..... B65D 43/164 206/427
(Continued)

FOREIGN PATENT DOCUMENTS

CA 2268998 10/2000
EP 1428764 6/2004
(Continued)

*Primary Examiner* — Kareen K Thomas
(74) *Attorney, Agent, or Firm* — Clark Hill PLC; James R. Foley

(57) ABSTRACT

A lid arrangement (20) comprises first and second lids (22) for use in a container (12) comprising a wall arrangement (16). Each lid (22) is movable between open and closed positions. Each lid (22) comprises opposite first and second edges (124, 126), and a plurality of rib formations (132) extending transverse to the aforesaid edges (124, 126). When the first and second lids (22) are In the closed positions, the rib formations (132) of the first lid (22) overlap the rib formations (132) of the second lid (22), so that each rib formation (132) of the first lid (22) extends parallel to, and alongside, a corresponding rib formation (132) of the second lid (22) to provide a line of support (S) that extends across the lid arrangement (20) from the first edge (124) of the first lid (22) to the first edge (124) of the second lid (22).

18 Claims, 13 Drawing Sheets

(58) Field of Classification Search
CPC ..... B65D 43/165; B65D 21/064; B65D 1/22; B65D 2251/1083
See application file for complete search history.

(56) References Cited

U.S. PATENT DOCUMENTS 4,161,261 A * 7/1979 Frater ..... B65D 43/165 206/508
4,364,489 A * 12/1982 Alexeeff ..... B65D 43/163 220/826
4,688,675 A 8/1987 Miller et al.
5,328,048 A 7/1994 Stein
5,673,791 A * 10/1997 Jamison ..... B65D 25/005 206/508
6,041,931 A * 3/2000 Jacques ..... A01K 63/02 119/214
6,315,154 B1 11/2001 Newby, Sr.
7,841,487 B2 * 11/2010 Miller ..... B29C 45/006 220/826
8,066,143 B2 * 11/2011 Baltz ..... B65D 21/064 220/324
8,286,828 B2 * 10/2012 Schafer ..... B65D 11/18 220/826
2011/0158761 A1 * 6/2011 Jackson ..... B65D 21/064 410/96
2015/0108154 A1 4/2015 Greenberg
2016/0122076 A1 5/2016 Mazza
2016/0347501 A1 * 12/2016 Jowett ..... B65D 71/0096

FOREIGN PATENT DOCUMENTS

FR 1404760 7/1965
GB 2463330 3/2010
GB 2471969 1/2011
GB 2522091 7/2015
JP 2011251724 12/2011
WO 2015104521 7/2015

* cited by examiner

OR RELATING TO LID ARRANGEMENTS

This invention relates to lid arrangements. This invention also relates to lids. More particularly, but not exclusively, this invention relates to containers incorporating lid arrangements. This invention also relates to hinge pins.

Containers are locked shut by the use of straps secured around them. However, the hinge pins of known containers can be removed to allow illicit access to the contents. In addition, the lids of known containers have a tendency to deform inwardly when a weight, such as a full container, is placed on the lids when closed.

According to a first aspect of this invention, there is provided a lid arrangement comprising:

first and second lids for use in a container comprising a wall arrangement, each lid being movable between open and closed positions;

each lid comprises opposite first and second edges, and a plurality of rib formations extending transverse to the aforesaid edges;

wherein when the first and second lids are in the closed positions, the rib formations of the first lid overlap the rib formations of the second lid at the respective first edges, each rib formation of the first lid extending parallel to, and alongside, a corresponding rib formation of the second lid to provide a line of support that extends across the lid arrangement from the second edge of the first lid to the second edge of the second lid.

According to a second aspect of this invention, there is provided a lid arrangement comprising:

first and second lids for use in a container comprising a wall arrangement, each lid being movable between open and closed positions;

each lid comprises opposite first and second edges, and a plurality of rib formations extending transverse to the aforesaid edges;

wherein when the first and second lids are in the closed positions, the rib formations of the first lid overlap the rib formations of the second lid at the respective first edges, each rib formation of the first lid extending parallel to, and alongside, a corresponding rib formation of the second lid to provide a line of support that extends across the lid arrangement from the second edge of the first lid to the second edge of the second lid;

each lid having opposite side edges and a hinge portion arranged between the edges, and each lid further including a hinge pin;

the hinge portion comprising a hinge member through which the hinge pin extends;

the hinge pin comprising an elongate member having opposite ends, and an end stop portion extending radially outwardly from one of said ends;

wherein the end stop portion is disposed in the hinge portion and the elongate member extends from the end portion through the hinge member towards one of the side edges of the lid.

The first edge of each of the first and second lids may overlap each other when the lids are in the closed positions. Adjacent rib formations of the second lid may provide a second projecting portion at the first edge of the second lid.

The rib formations may extend substantially wholly across the first and second lids obliquely from the second edge to the respective first and second projecting portions.

Adjacent rib formations of the first lid may define therebetween a first recess extending from the free edge of the first lid. Adjacent rib formations of the second lid may define therebetween a second recess extending from the free edge of the second lid.

The first projecting portion provided by the first lid may be received by the second recess of the second lid when the lids are in their closed positions. The second projecting portion provided by the second lid may be received by the first recess of the first lid when the lids are in their closed positions.

The first edge may comprise a free edge. The second edge may comprise a hinged edge to attach the lid to the wall arrangement. The plurality of rib formations may extend between the hinged and free edges.

According to a third aspect of this invention, there is provided a lid arrangement comprising:

a lid having opposite side edges and a hinge portion arranged between the edges; and a hinge pin;

the hinge portion comprising a hinge member through which the hinge pin extends;

the hinge pin comprising an elongate member having opposite ends, and an end stop portion extending radially outwardly from one of said ends;

wherein the end stop portion is disposed in the hinge portion and the elongate member extends from the end portion through the hinge member towards one of the side edges of the lid.

A pointed tip may be provided at the end of the elongate member opposite the end stop portion.

The end region may be disposed in a central region of the hinge portion. The elongate member may extend therefrom to said one of the side edges. The hinge member may be arranged between the central region and said one of the side edges.

The lid may be movable between open and closed positions. The hinge portion may include a cover member to cover the end stop portion when the lid is in the closed position. The cover member may be arranged in the central region of the hinge portion.

The hinge member may comprise a pivot element through which the hinge pin extends to allow the lid to pivot between the open and closed positions. The hinge member may comprise a pair of said pivot elements. The hinge member may have opposite ends. A respective pivot element may be provided at each end of the hinge member.

The hinge portion may comprise a plurality of the aforesaid hinge members between the central region and one of the side edges.

The cover member may comprise a shroud having an open face to allow access to the end stop portion when the lid is in the open position. The shroud may be arranged over the end stop portion when the lid is in the closed position.

The cover member may have an internal sloping surface to facilitate insertion or removal of the hinge pin. The opening may be coplanar with, or parallel to, the lid.

The hinge portion may comprise a second of the aforesaid hinge members between the central region and the other of the side edges. The lid arrangement may comprise a second of the aforesaid hinge pins.

The end stop portion of the second hinge pin may be disposed in the hinge portion. The elongate member of the second hinge pin may extend through the second hinge member between the central region and said other of the side edges.

The end stop portion of the second pin may be disposed in the central region of the hinge portion.

The hinge portion may comprise a plurality of the aforesaid second hinge members between the central region and said other of the side edges. The hinge portion may include a second cover member to cover the end stop portion of the second hinge pin when the lid is in the closed position. The second cover member may be arranged in the central region of the hinge portion. If desired, the first mentioned cover member and the second cover member may be a single cover member configured to cover the end stop portions of the first mentioned hinge pin and the second hinge pin.

According to a fourth aspect of this invention, there is provided a container assembly comprising a container and a lid arrangement thereon, the lid arrangement being as described above.

The container may comprise an upstanding wall and a hinge arrangement on the wall. The lid arrangement may be attached to the upstanding wall at the hinge arrangement. The hinge arrangement may comprise a hinge element aligned with the hinge member of the hinge portion.

The hinge pin may extend through the hinge element to secure the lid to the container. The hinge arrangement may comprise a plurality of the hinge elements.

The hinge arrangement may comprise a second hinge element aligned with the second hinge member of the hinge portion. The second hinge pin may extend through the second hinge element to secure the lid to the container. The hinge arrangement may comprise a plurality of the second hinge elements.

The container may comprise a further of the aforesaid upstanding walls opposite the aforesaid upstanding wall. The container may further include a further hinge arrangement on the further upstanding wall. A further of the aforesaid lid arrangements may be attached to the further upstanding wall at the further hinge arrangement.

According to a fifth aspect of this invention, there is provided a lid arrangement comprising:

first and second lids for use in a container comprising a wall arrangement, each lid being movable between open and closed positions;

wherein each lid comprises a hinged edge to attach the lid to the wall arrangement, a free edge opposite the hinged edge, and a plurality of rib formations extending transverse to the hinged and free edges;

wherein adjacent rib formations of the first lid define therebetween a first recess extending from the free edge of the first lid, and adjacent rib formations of the second lid define therebetween a second recess extending from the free edge of the second lid;

wherein adjacent rib formations of the first lid provide a first projecting portion at the free edge of the first lid, and adjacent rib formations of the second lid provide a second projecting portion at the free edge of the second lid;

wherein the rib formations extend obliquely from the hinged edge across the respective lids to the projecting portions, the rib formations extending substantially wholly across the respective lids; and wherein the first projecting portion provided by the first lid is received in the second recess of the second lid when the lids are in their closed positions, and the second projecting portion provided by the second lid is received by the first recess of the first lid when the lids are in their closed positions.

According to a sixth aspect of this invention, there is provided a lid arrangement comprising:

first and second lids for use in a container comprising a wall arrangement, each lid being movable between open and closed positions;

wherein each lid comprises a hinged edge to attach the lid to the wall arrangement, a free edge opposite the hinged edge, and a plurality of rib formations extending transverse to the hinged and free edges;

wherein adjacent rib formations of the first lid define therebetween a first recess extending from the free edge of the first lid, and adjacent rib formations of the second lid define therebetween a second recess extending from the free edge of the second lid;

wherein adjacent rib formations of the first lid provide a first projecting portion at the free edge of the first lid, and adjacent rib formations of the second lid provide a second projecting portion at the free edge of the second lid;

wherein the rib formations extend obliquely from the hinged edge across the respective lids to the projecting portions, the rib formations extending substantially wholly across the respective lids; and wherein the first projecting portion provided by the first lid is received in the second recess of the second lid when the lids are in their closed positions, and the second projecting portion provided by the second lid is received by the first recess of the first lid when the lids are in their closed positions.

and each lid further including a hinge pin;

the hinge portion comprising a hinge member through which the hinge pin extends;

the hinge pin comprising an elongate member having opposite ends, and an end stop portion extending radially outwardly from one of said ends;

wherein the end stop portion is disposed in the hinge portion and the elongate member extends from the end portion through the hinge member towards one of the side edges of the lid.

Adjacent rib formations of each of the first and second lids may define a respective further recess therebetween, said further recess extending from the hinged edge. The rib formations defining the further recesses may taper towards each other from the hinged edge.

The further recess of each lid may be aligned with the first or second projecting portion. The rib formations providing the first and second projecting portions may define the further recesses.

When the first and second lids are in the open positions, the further recess of each of the first and second lids may receive a projecting portion of a lid of another container nested in the first mentioned container.

According to a seventh aspect of this invention, there is provided a container arrangement comprising:

first and second containers, each of the first and second containers having a lid and a wall arrangement, each lid being movable between open and closed positions;

wherein each of the lids of the first and second containers have a hinged edge to attach the lids to the respective wall arrangement, a free edge opposite the hinged edge, and a plurality of rib formations extending transverse to the hinged and free edges;

wherein adjacent rib formations define a recess therebetween extending from the hinged edge;

wherein adjacent rib formations of each lid provide a projecting portion at the free edge of the respective lid; and wherein when the lids are in the open position, and the second container is nested within the first container, the projecting portion of the lid of the second projection is received in the recess defined between the rib formations of the lid of the first container.

According to an eighth aspect of this invention, there is provided a container arrangement comprising:

first and second containers, each of the first and second containers having a lid and a wall arrangement, each lid being movable between open and closed positions;

wherein each of the lids of the first and second containers have a hinged edge to attach the lids to the respective wall arrangement, a free edge opposite the hinged edge, and a plurality of rib formations extending transverse to the hinged and free edges;

wherein adjacent rib formations define a recess therebetween extending from the hinged edge;

wherein adjacent rib formations of each lid provide a projecting portion at the free edge of the respective lid; and wherein when the lids are in the open position, and the second container is nested within the first container, the projecting portion of the lid of the second projection is received in the recess defined between the rib formations of the lid of the first container;

and each lid further including a hinge pin;

the hinge portion comprising a hinge member through which the hinge pin extends;

the hinge pin comprising an elongate member having opposite ends, and an end stop portion extending radially outwardly from one of said ends;

wherein the end stop portion is disposed in the hinge portion and the elongate member extends from the end portion through the hinge member towards one of the side edges of the lid.

Each of the first and second containers of the fourth aspect of the invention may comprise first and second lids for use in a container comprising a wall arrangement, each lid being movable between open and closed positions.

Each lid of the fourth aspect of the invention may comprise a hinged edge to attach the lid to the wall arrangement, a free edge opposite the hinged edge, and a plurality of rib formations extending transverse to the hinged and free edges.

Adjacent rib formations of the first lid of the fourth aspect of the invention may define therebetween a first recess extending from the free edge of the first lid. Adjacent rib formations of the second lid define therebetween a second recess extending from the free edge of the second lid;

Adjacent rib formations of the first lid of the fourth aspect of the invention may provide a first projecting portion at the free edge of the first lid. Adjacent rib formations of the second lid may provide a second projecting portion at the free edge of the second lid.

The rib formations of the fourth aspect of the invention may extend obliquely from the hinged edge across the respective lids to the projecting portions. The rib formations may extend substantially wholly across the respective lids.

The first projecting portion provided by the first lid of the fourth aspect of the invention may be received in the second recess of the second lid when the lids are in their closed positions. The second projecting portion provided by the second lid may be received by the first recess of the first lid when the lids are in their closed positions.

Adjacent rib formations of the first lid of the fourth aspect of the invention may define therebetween a first recess extending from the free edge of the first lid. Adjacent rib formations of the second lid may define therebetween a second recess extending from the free edge of the second lid.

Adjacent rib formations of the first lid of the fourth aspect of the invention may provide a first projecting portion at the free edge of the first lid. Adjacent rib formations of the second lid may provide a second projecting portion at the free edge of the second lid.

The first projecting portion provided by the first lid of the fourth aspect of the invention may be received in the second recess of the second lid when the lids are in their closed positions. The second projecting portion provided by the second lid may be received by the first recess of the first lid when the lids are in their closed positions.

Each of the first and second lids comprises a main part. The hinged edge may be an edge of the main part. The free edge may be another edge of the main part. The rib formations may extend across the main part.

The adjacent rib formations defining the first recess may taper towards each other from the free edge of the first lid. The adjacent rib formations defining the second recess may taper towards each other from the free edge of the second lid.

The first projecting portion may extend outwardly from the free edge of the first lid. The adjacent rib formations providing the first projecting portion may taper towards each other outwardly from the free edge of the first lid.

The second projecting portion may extend outwardly from the free edge of the second lid. The adjacent rib formations providing the second projecting portion may taper towards each other outwardly from the free edge of the second lid.

When the first and second lids are in their closed positions, the projecting portions of each of the first and second lids may extend across the free edge of the other of the first and second lids.

When the first and second lids are in the closed positions, the rib formations of the first lid may overlap the lids of the second lid. In this position, each rib formation of the first lid may extend parallel to, and alongside, a corresponding rib formation of the second lid to provide a line of support that extends across the lid arrangement 2*s* from the hinged edge of the first lid to the hinged edge of the second lid.

The rib formations may comprise strengthening ribs.

Embodiments of the invention will now be described by way of example only, with reference to the accompanying drawings, in which.

Figure 1:
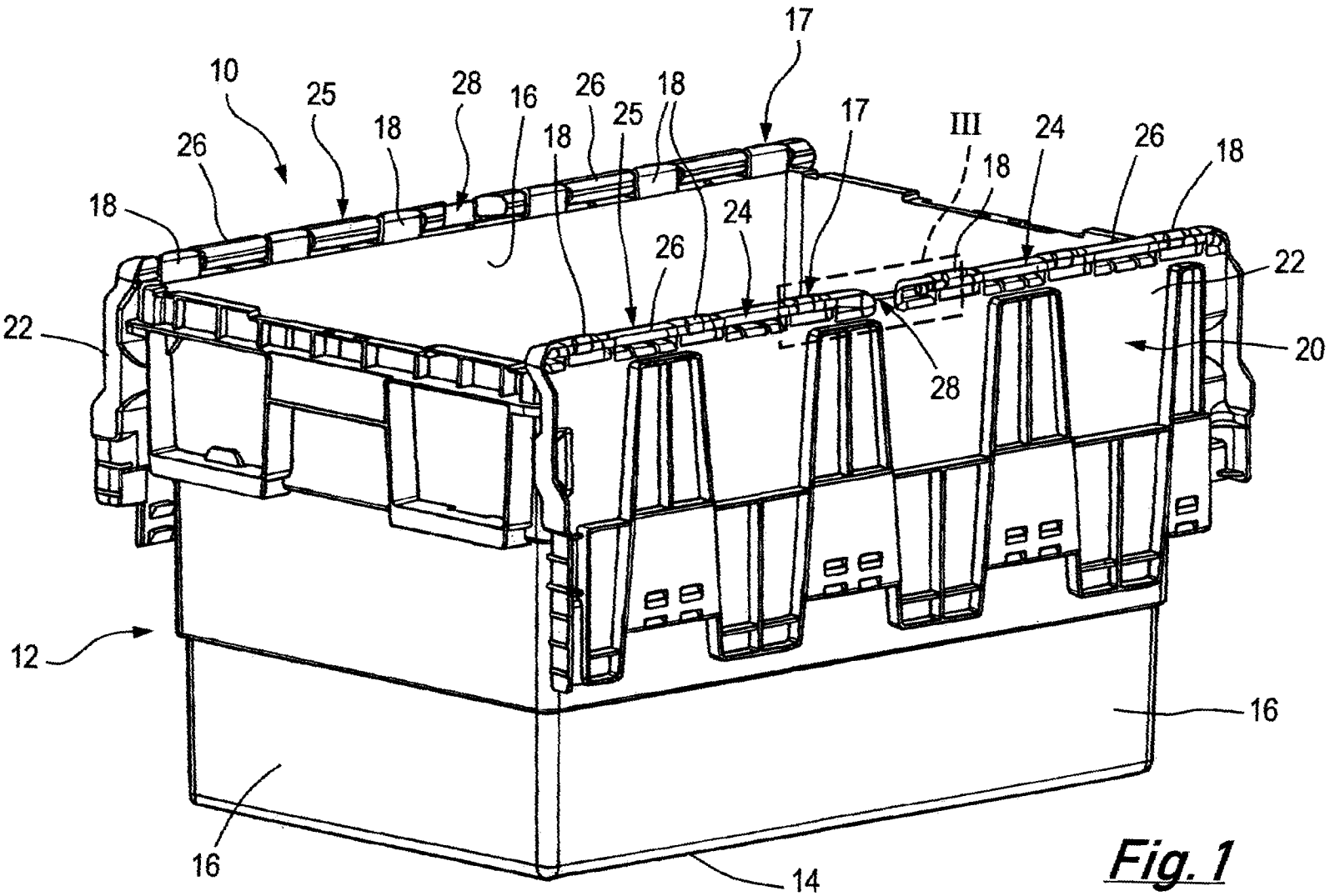
FIG. 1 is a top perspective of a container assembly, showing lid arrangements in an open position.

FIGS. 1 to 7 show a container assembly 10 comprising a container 12 and two lid arrangements 20 thereon. The container 12 comprises a base 14 and four upstanding side walls 16.

Two of the side walls 16 arranged opposite each other are provided with respective hinge arrangements 17 to allow the lid arrangements 20 to be pivotally attached thereto.

Figure 2:
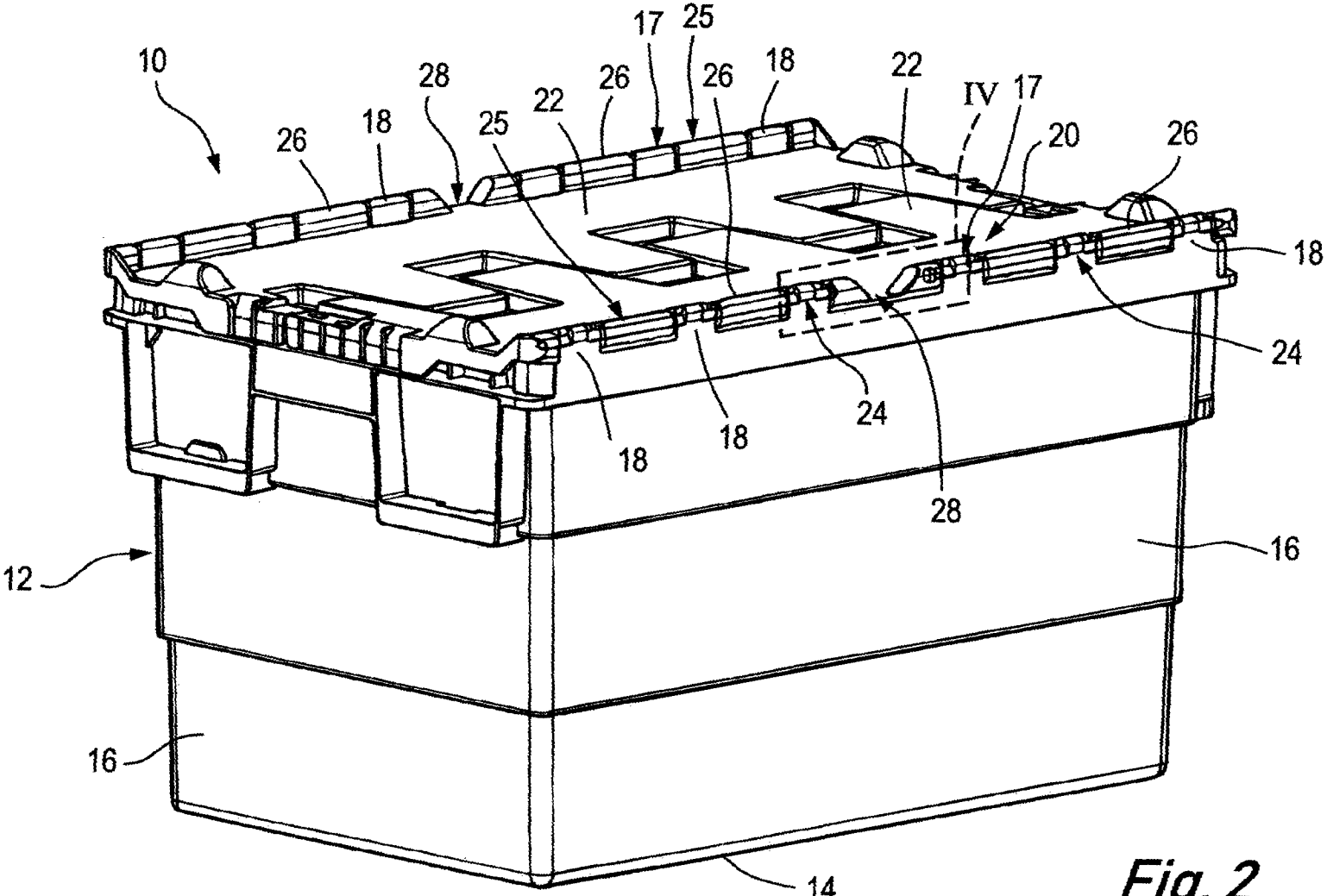
FIG. 2 is a view similar to FIG. 1, but showing the lid arrangements in a closed position.
Figure 3:
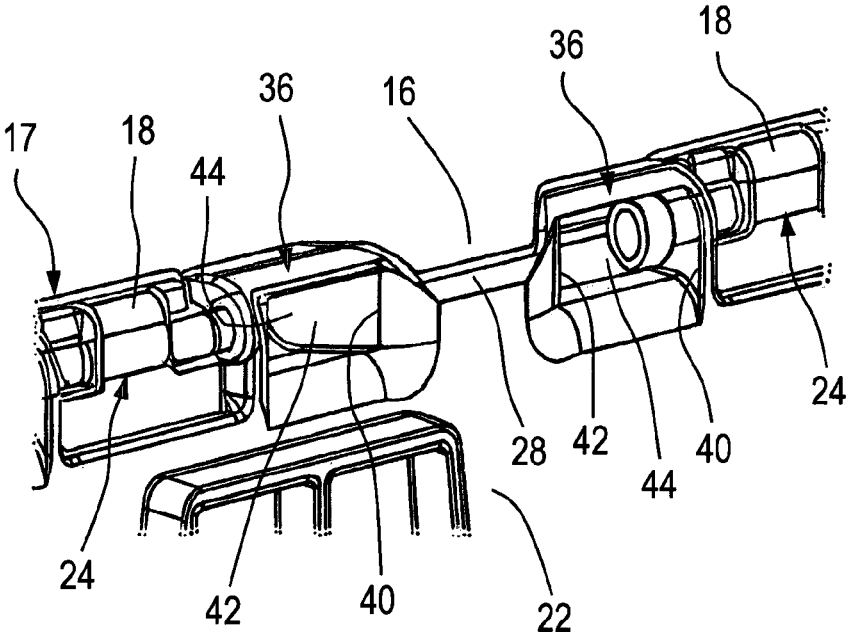
FIG. 3 is a close up view of the region marked III in FIG. 1.
Figure 4:
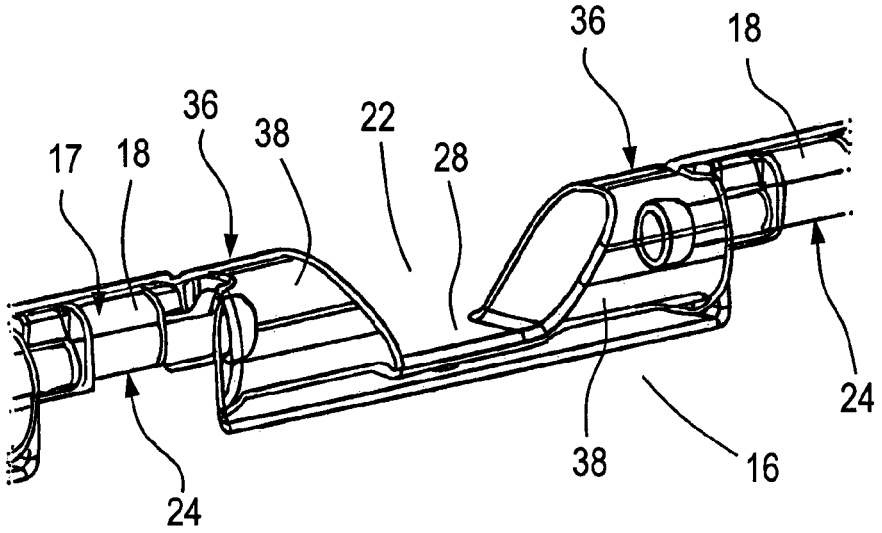
FIG. 4 is a close up view of the region marked III in FIG. 2.

The lid arrangements 20 comprise lids 22 that are pivotally movable between an open position shown in FIG. 1 and a closed position shown in FIG. 2. Each of the hinge arrangements 17 comprises a plurality of hinge elements 18.

Each of the lid arrangements 20 also includes first and second hinge pins 24 to pivotally attach the lid 22 to a respective one of the hinge arrangements 17 of the container 12.

Each lid 22 has opposite first and second side edges 23A, 23B and a hinge portion 25 extending between the side edges 23A, 23B. The hinge portion 25 has a central region 28 and a plurality of hinge members 26 through which the hinge pins 24 extend.

A plurality of first hinge members 26 extend from the central region 28 to the first side edge 23A. The first hinge pin 24 extends through the first hinge members 26. A plurality of second hinge members 26 extend from the central region 28 to the second side edge 23B. The second hinge pin 24 extends through the second hinge members 26.

When the lids 22 are arranged on the container 12, the first and second hinge members 26 on each lid 22 are aligned with the hinge elements 18 on the respective upstanding walls 16. This allows the hinge pins 24 to extend through the hinge members 26 and the hinge elements 18, to provide a hinge attaching the lids 22 to the upstanding walls 16.

Each hinge member 26 has a pivot element 30 at each of its opposite ends through which the hinge pin 24 extends to allow the lid 22 to pivot from between its open and closed positions.

Each of the pivot elements 30 comprises a web portion 32 extending across the end of the hinge member 26, the web portion 32 defining an aperture 34 through which the hinge pin 24 extends.

The hinge portions 25 of each lid 22 further include first and second cover members 36 within the central region 28. The cover members 36 extend over one end of the respective first and second hinge pins 24.

Each cover member 36 comprises a shroud 38 defining an opening 40 to allow insertion and removal of the hinge pins 24 when the lids 22 are in their open positions. Each cover member 36 has one of the aforesaid pivot elements 30 at each end thereof.

Figure 5:
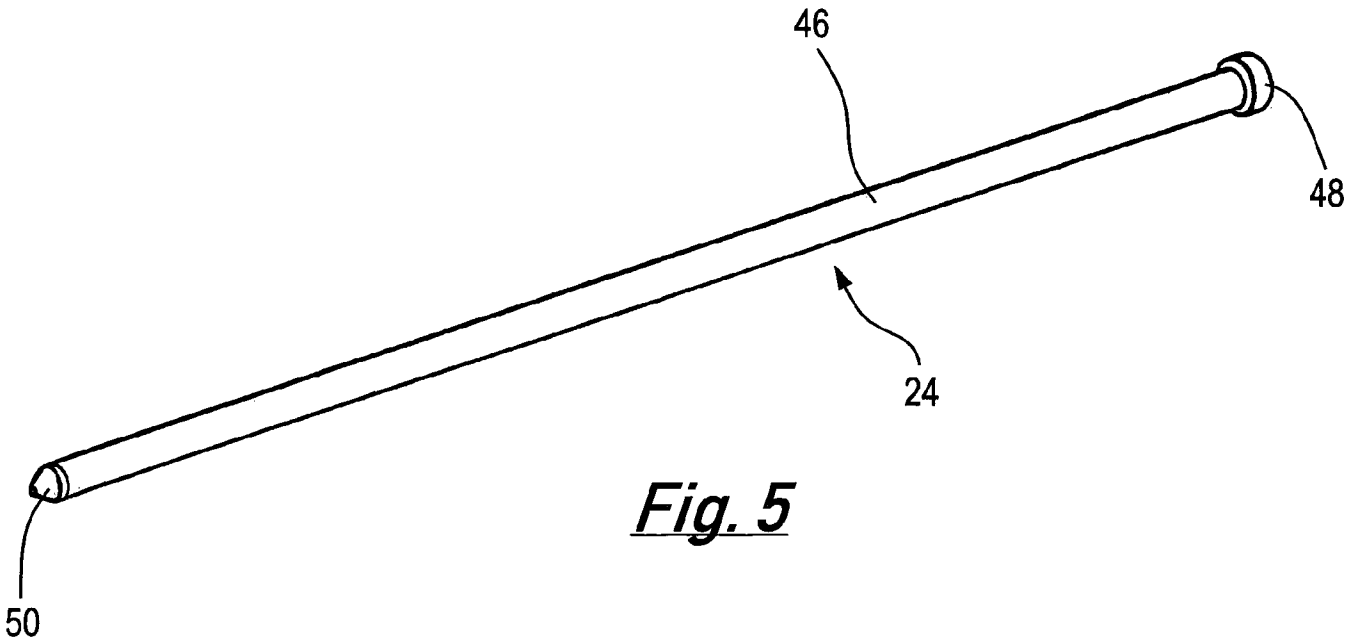
FIG. 5 is a perspective view of a hinge pin for use in the lid arrangements.

Referring to FIG. 5, one of the hinge pins 24 is shown, which comprises an elongate member 46 having opposite ends. A radially outwardly extending end stop member 48 is provided at one of the ends of the elongate member 46.

The end stop member 48 is in the form of a flange. A pointed tip 50 is provided at the opposite end of the elongate member 46.

Each cover member 36 defines a receiving space 44 in which the end stop member 48 is received. The receiving space 44 has an internal sloping surface 42 to facilitate insertion and removal of the hinge pin 24 through the opening 40. The opening 40 is arranged so that, when the lid 22 is in the closed condition, the opening 40 is closed by an upper edge of the wall 16, thereby preventing removal of the hinge pin 24 through the opening 40.

The hinge pins 24 are inserted through the hinge elements 18 and the hinge members 26 via the cover members 36 when the lids 22 are in their open positions. The sloping surfaces 42 act as guide surfaces to guide the hinge pins 24 through the hinge members 26 and hinge elements 18.

When each hinge pin 24 is inserted into the hinge members 26 and hinge elements 18, the end stop member 48 is received in the receiving space 44 defined by the cover member 36. The end stop members 48 are wider than the aperture 34 in the pivot portion of the cover member 36.

Thus, the hinge pins 24 cannot be removed by pulling them at the tip 50 through the hinge members 26 and the hinge elements 18. The only way to remove the hinge pins 24 is by pulling the end stop members 48 through the openings 40 defined by the cover members 36

When the lids 22 are in their closed position, the shroud 38 extends over the end stop member 48 thereby preventing access to the end stop member 48. Thus, when the lids 22 are secured in their closed position, e.g. by a strap wrapped around the container 12 arrangement, access to the end stop member 48 is not possible, thereby preventing unauthorised removal of the hinge pins 24.

FIGS. 6 and 8 to 11 show a lid arrangement 100 (see FIGS. 9, 10 and 11) comprising first and second lids 22, 22A. Each of the first and second lids 22, 22A has a substantially flat main part 122 having a hinged edge 124 comprising the hinge members 26.

The main part 122 of each of the first and second lids 22, 22A also has a free edge 126 opposite the hinged edge 124. The main part 122 has a lower face 128 and an upper face 130.

Figure 8:
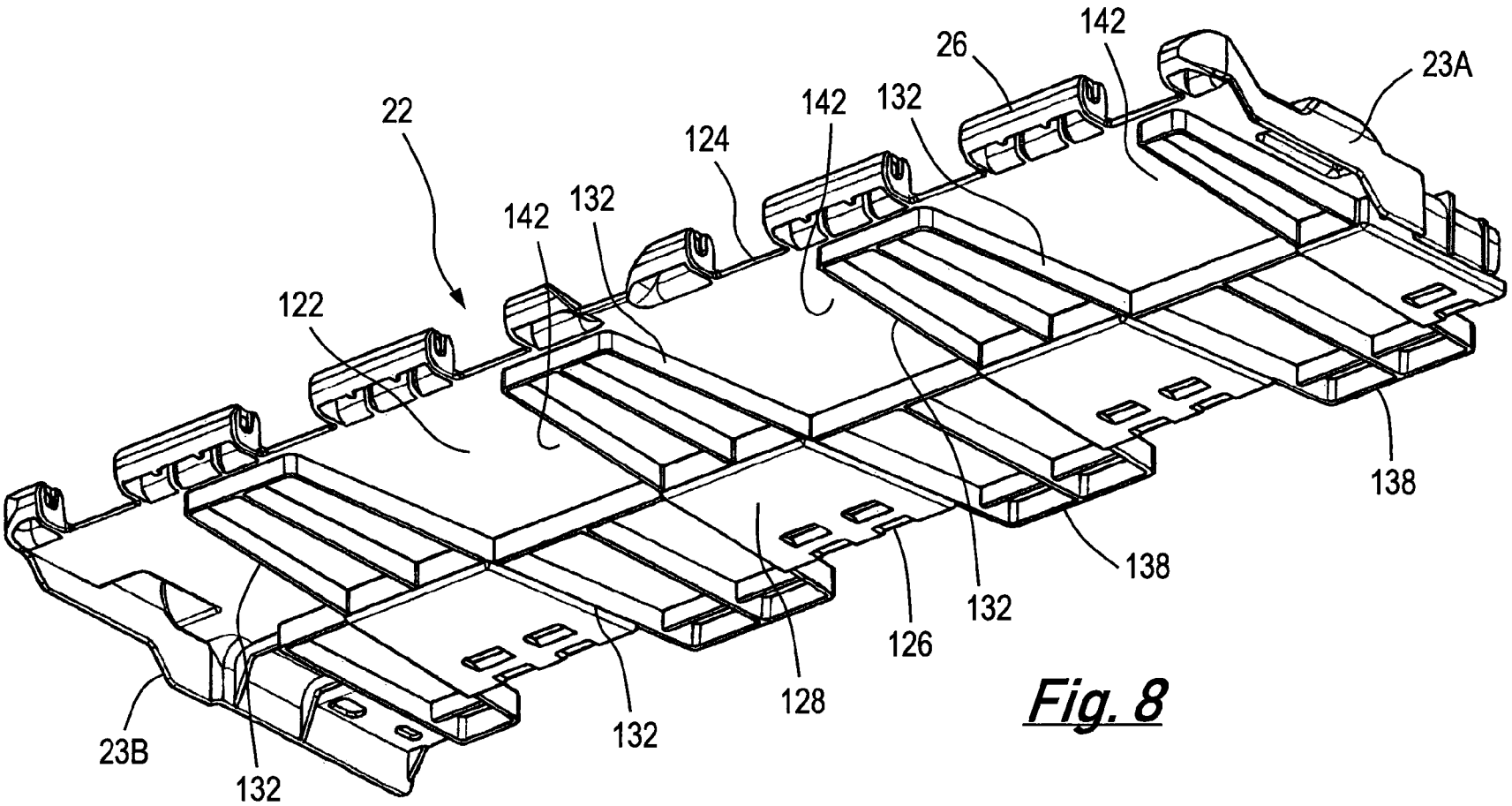
FIG. 8 is a bottom perspective view of the lid shown in FIG. 6.
Figure 10:
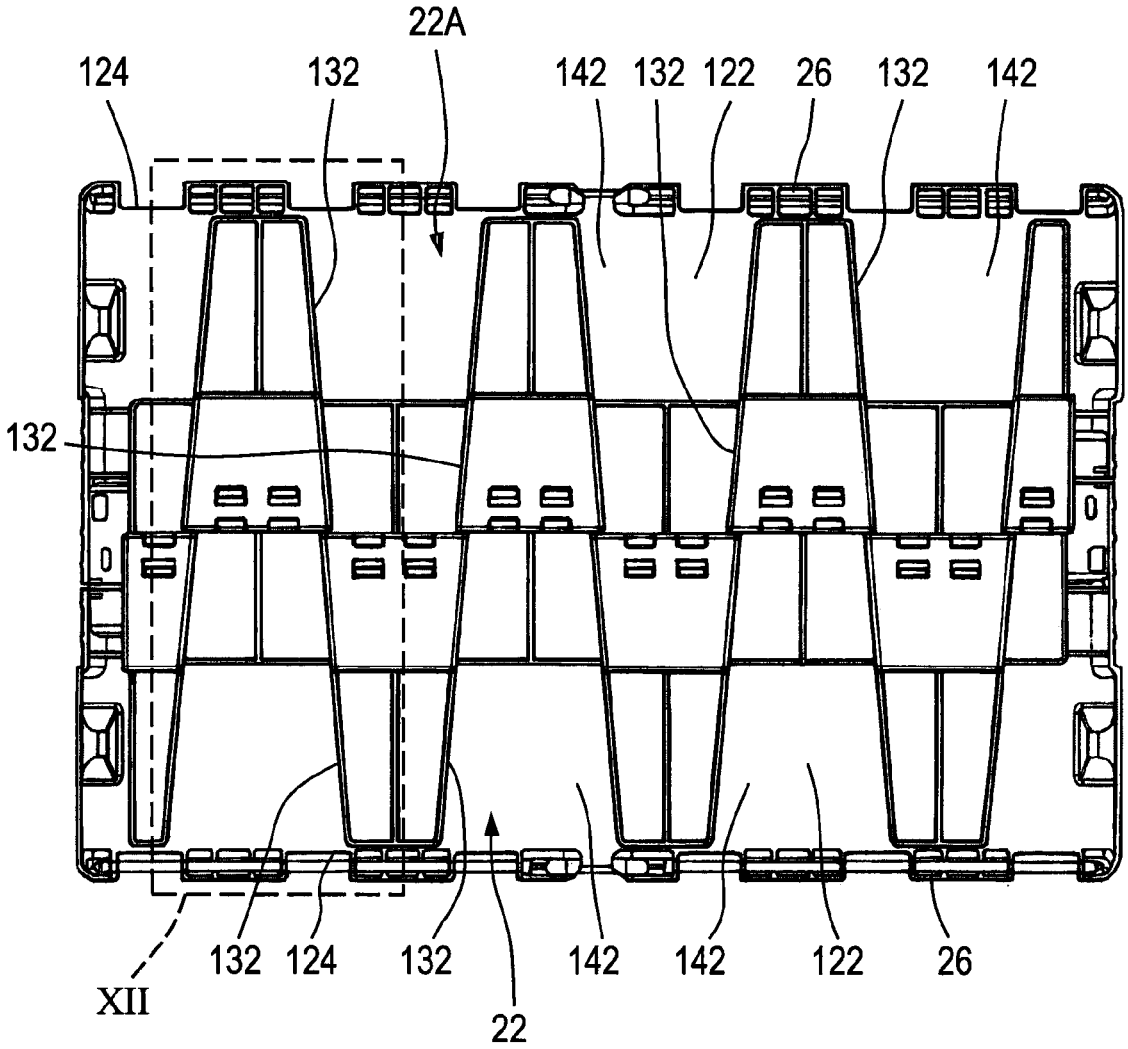
FIG. 10 is a bottom plan view of the lid arrangement shown in FIG. 9.

Referring to FIGS. 8 and 10, which show the lower face 128 of the lids 22, 22*a*. Each of the lids 22, 22A comprise a plurality of rib formations in the form of strengthening ribs 132 extending across the lids 22, 22A. The strengthening ribs 132 extend obliquely from the hinged edge 124 across the main part 122 to the free edge 126.

The strengthening ribs 132 extend at an angle of between 82° and 87° from the hinged edge 124. A typical angle is substantially 85°. Adjacent strengthening ribs 132 are slanted in opposite directions across the main part 122.

Adjacent strengthening ribs 132 of the first lid 22 define therebetween a plurality of first recesses 134 in the upper face 130. The first recesses 134 extend inwardly from the free edge 126 of the first lid 22 across the main part 122.

Similarly, adjacent strengthening ribs 132 of the second lid 22A define therebetween a plurality of second recesses 136. The second recesses 136 extend from the free edge 126 of the second lid 22A across the main part 122.

Adjacent strengthening ribs 132 of the first lid 22 provide a plurality of first projecting portions 138 extending outwardly from the free edge 126 of the first lid 22. Adjacent strengthening ribs 132 of the second lid 22A provide a plurality of second projecting portions 140 at the free edge 126 of the second lid 22A. The projecting portions extend outwardly beyond the free edge 126 of the first and second lids 22, 22A.

Figure 6:
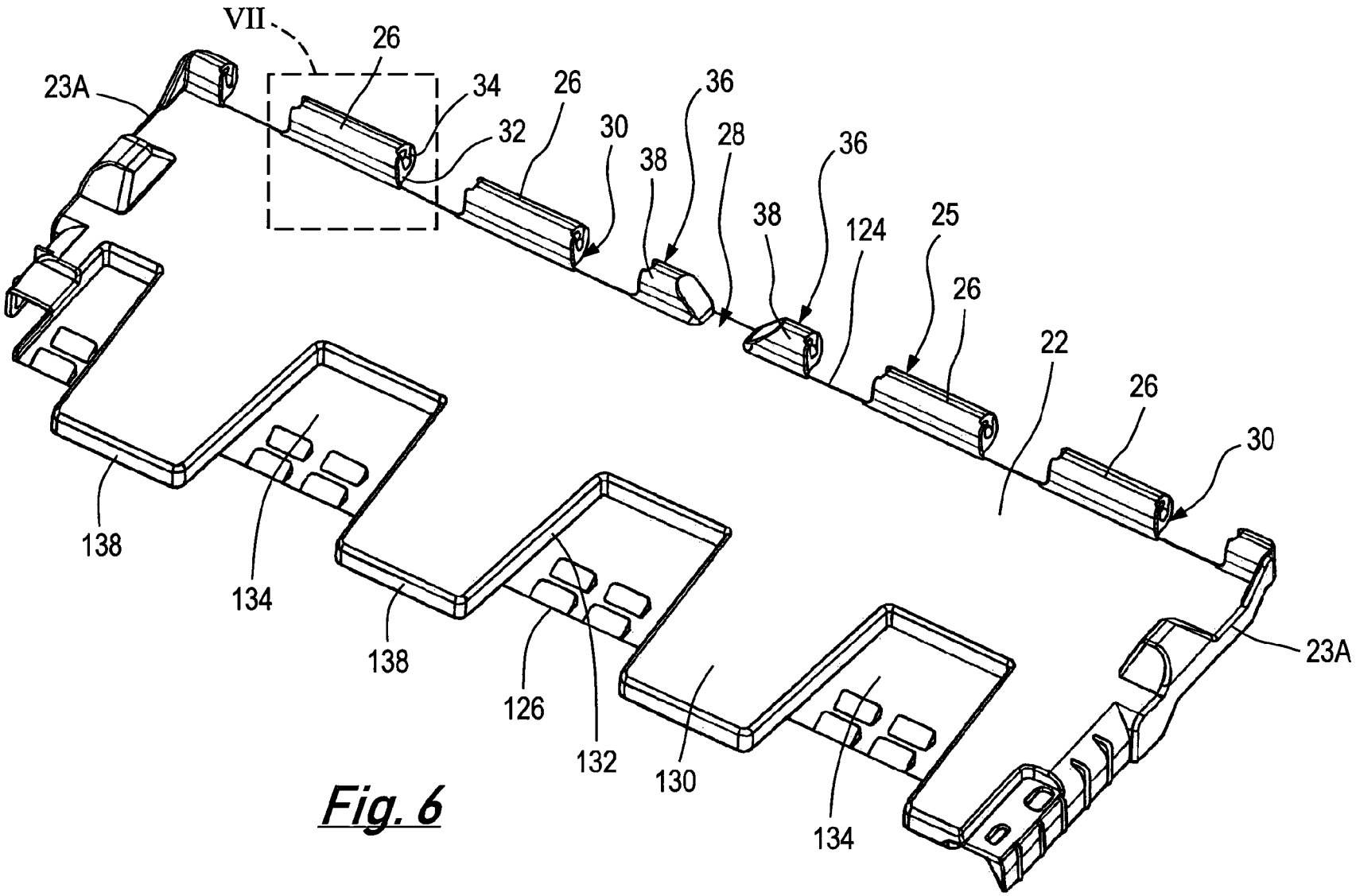
FIG. 6 is a top perspective view of a lid.
Figure 7:
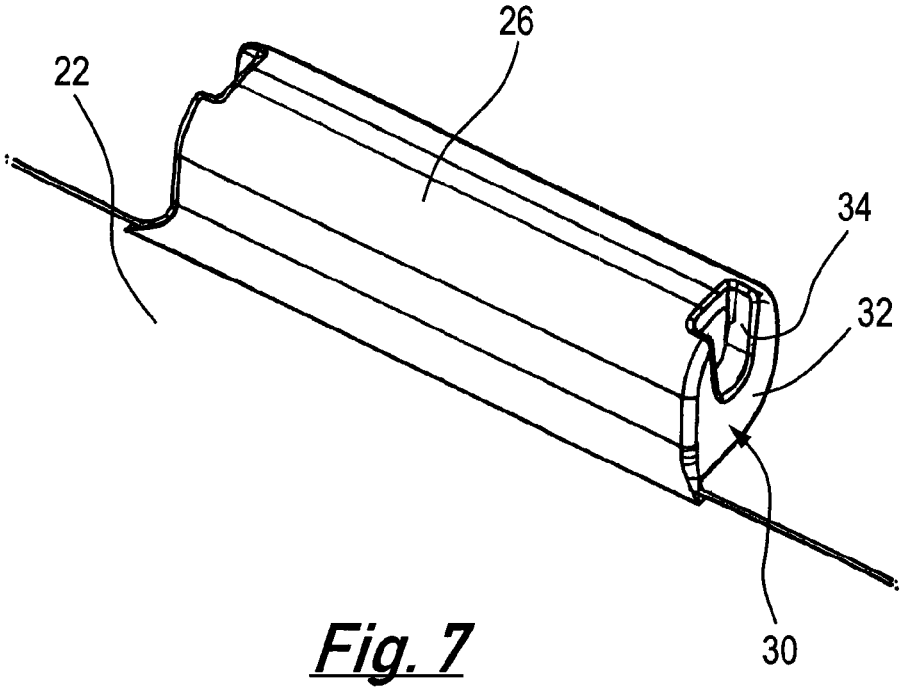
FIG. 7 is a close up of the region marked VII in FIG. 6.

As can be seen from FIGS. 6 and 8, which show the first lid 22, the first recesses 134 alternate with the first projecting portions 138. In the case of the second lid 22A, the second recesses 136 alternate with the second projecting portions 140.

Each of the first and second lids 22, 22A is pivotally movable about the hinge members 26 from an open position of each of the first and second lids 22, 22A to a closed position of each of the first and second lids 22, 22A.

Figure 9:
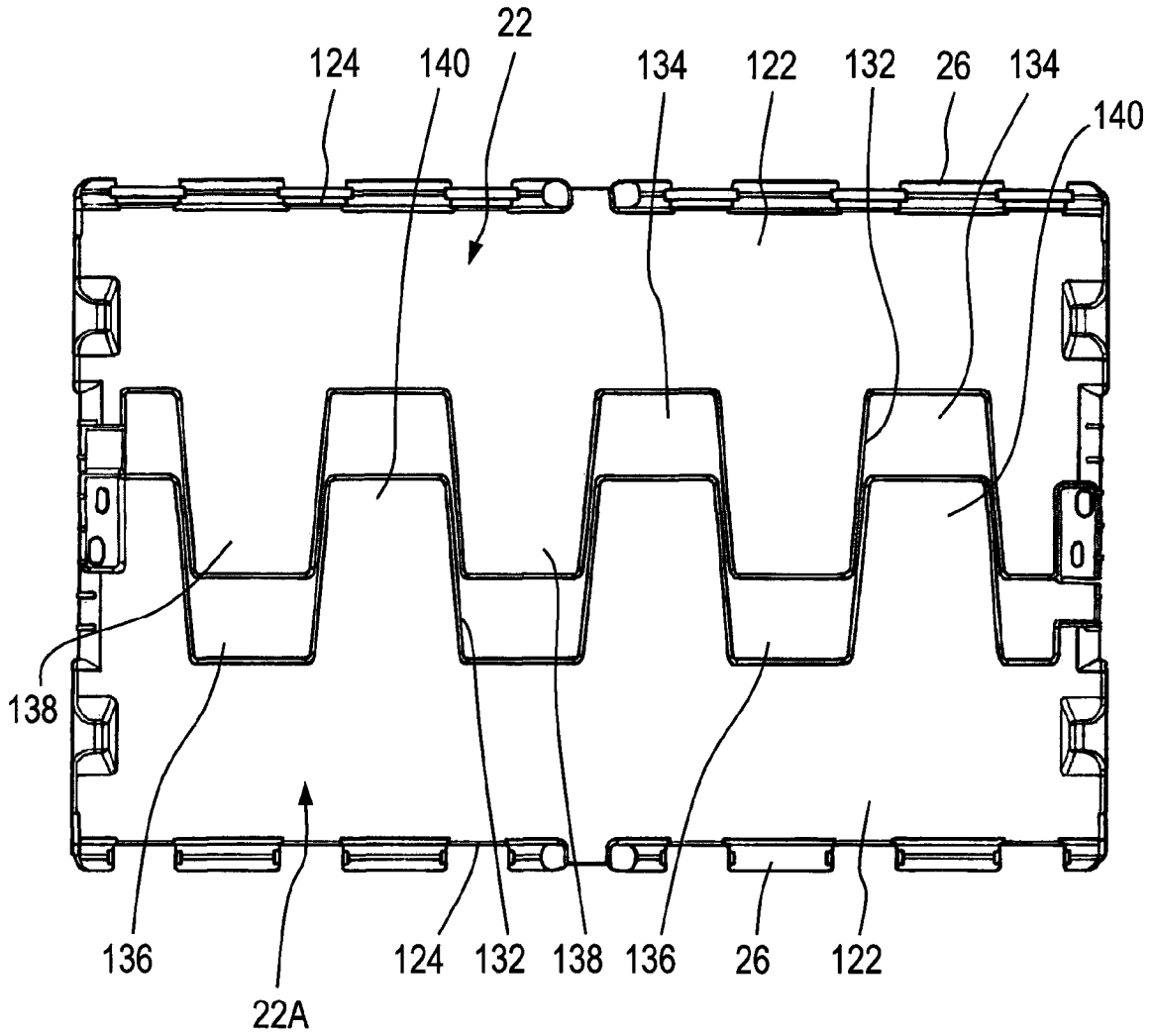
FIG. 9 is a top plan view of a lid arrangement.
Figure 11:
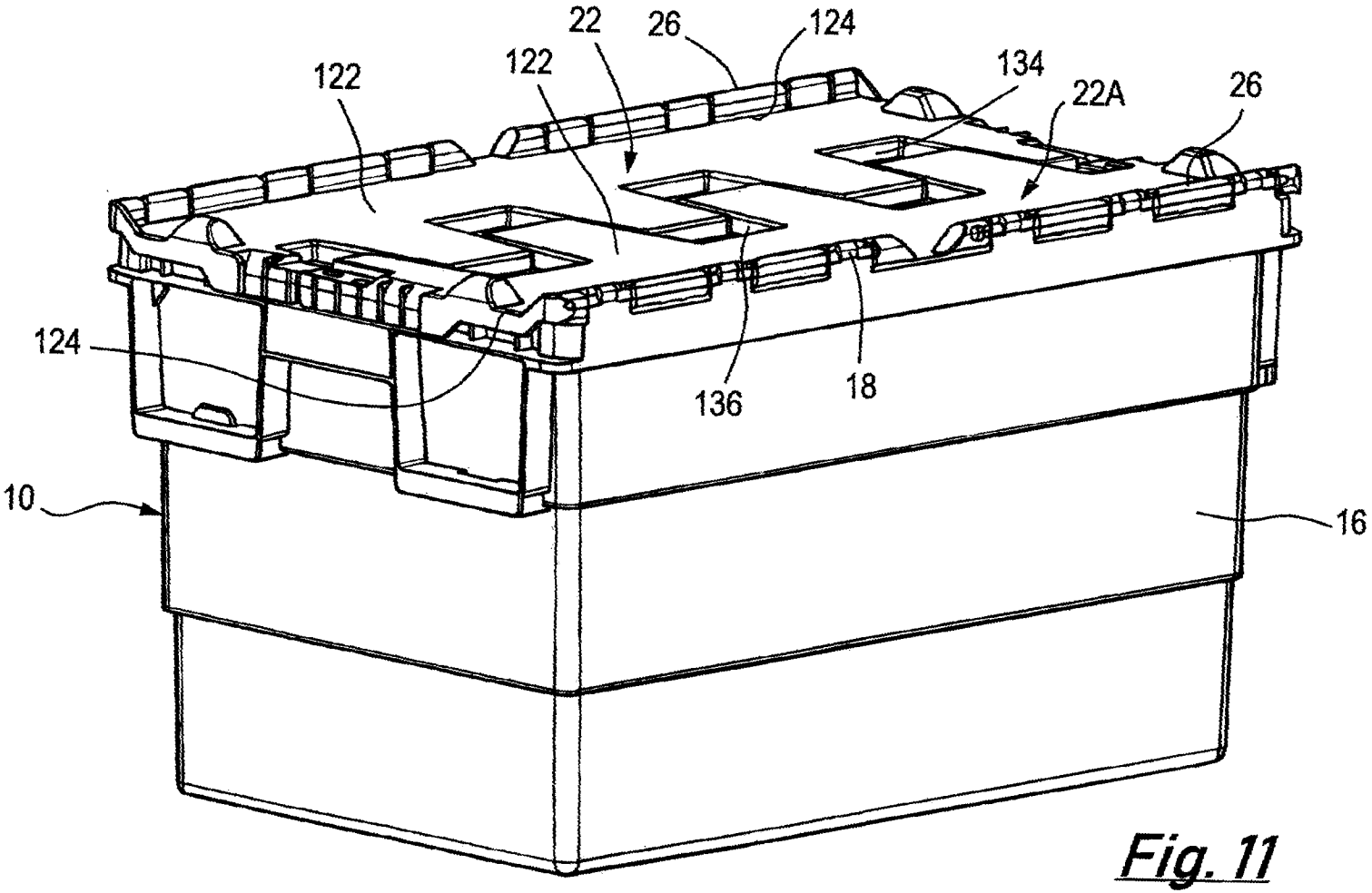
FIG. 11 is a top perspective view of a container.

When the first and second lids 22, 22A are in their closed positions, the first projecting portions 138 of the first lid 22 are received in the second recesses 136 of the second lid 22A, and the second projecting portions 140 of the second lid 22A are received in the first recesses 134 of the first lid 22, as shown in FIGS. 9 and 11. This has the effect of securing the first and second lids 22, 22A to each other.

Set out below is a description with reference to FIG. 12 of the interaction of the strengthening ribs 132 of the first lid 22 with the strengthening ribs 132 of the second lid 22A when the lids 22, 22A are in the closed position.

Figure 12:
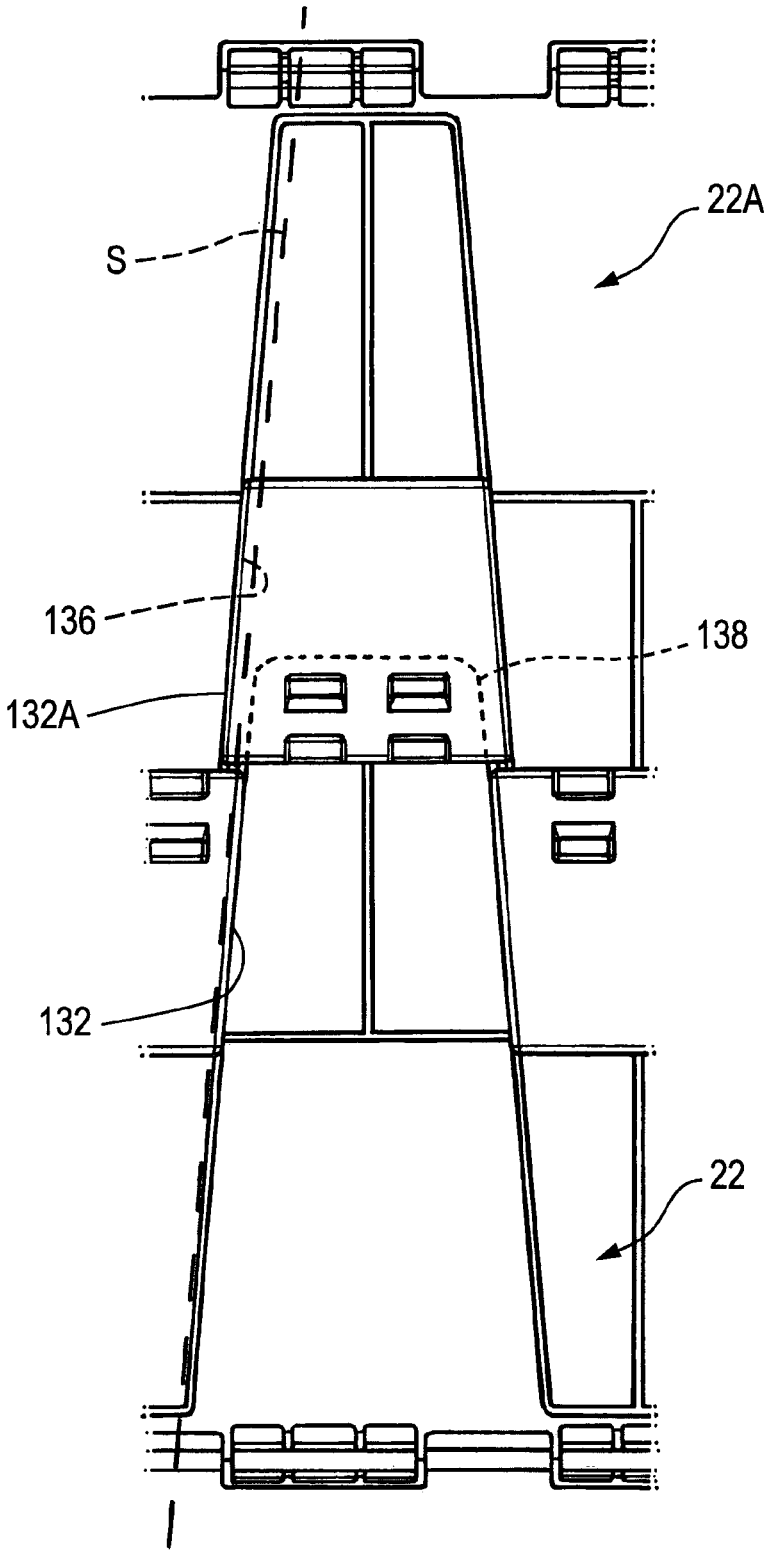
FIG. 12 is a close up view of the region marked XII in FIG. 10.

In FIG. 12, one of the strengthening ribs of the first lid 22 is designated 132, and one of the strengthening ribs of the second lid 22A is designated 132A. The first projecting portion 138 of the first lid 22 is shown in broken lines, and is received in the second recess 136 of the second lid 22A.

The strengthening rib 132 of the first lid 22 extends parallel to the strengthening rib 132A of the second lid 22A. In the region of the first projecting portion 138, the strengthening rib 132 lies alongside the strengthening rib 132A. In the arrangement shown in FIG. 12, the strengthening ribs 132 and 132A are in near alignment and create a line of support shown by a broken line and designated S.

In the embodiment shown, the line of support S extends along both of the strengthening ribs 132, 132A and helps to prevent the lid 22, 22A from collapsing inwards. The creation of a line of support along at each of the strengthening ribs 132, 132A when the lids 22, 22A are in their closed positions. Thus, a plurality of lines of support S are created along both lids 22, 22A, thereby increasing the strength of the lids 22, 22A over lids of prior art containers.

Another feature of the lids 22, 22A is that the strengthening ribs 132 providing the first and second projecting portions 138, 140 define further recesses 142 extending inwardly from the hinged edge 124 of each of the lids 22, 22A. The strengthening ribs 132 defining the further recesses are slanted towards each other so that the further recesses 142 are wider than the projecting portions 138, 140.

The purpose of the further recesses 142 is to reduce the amount of space occupied by the containers 10 when they are nested within one another.

Figure 13:
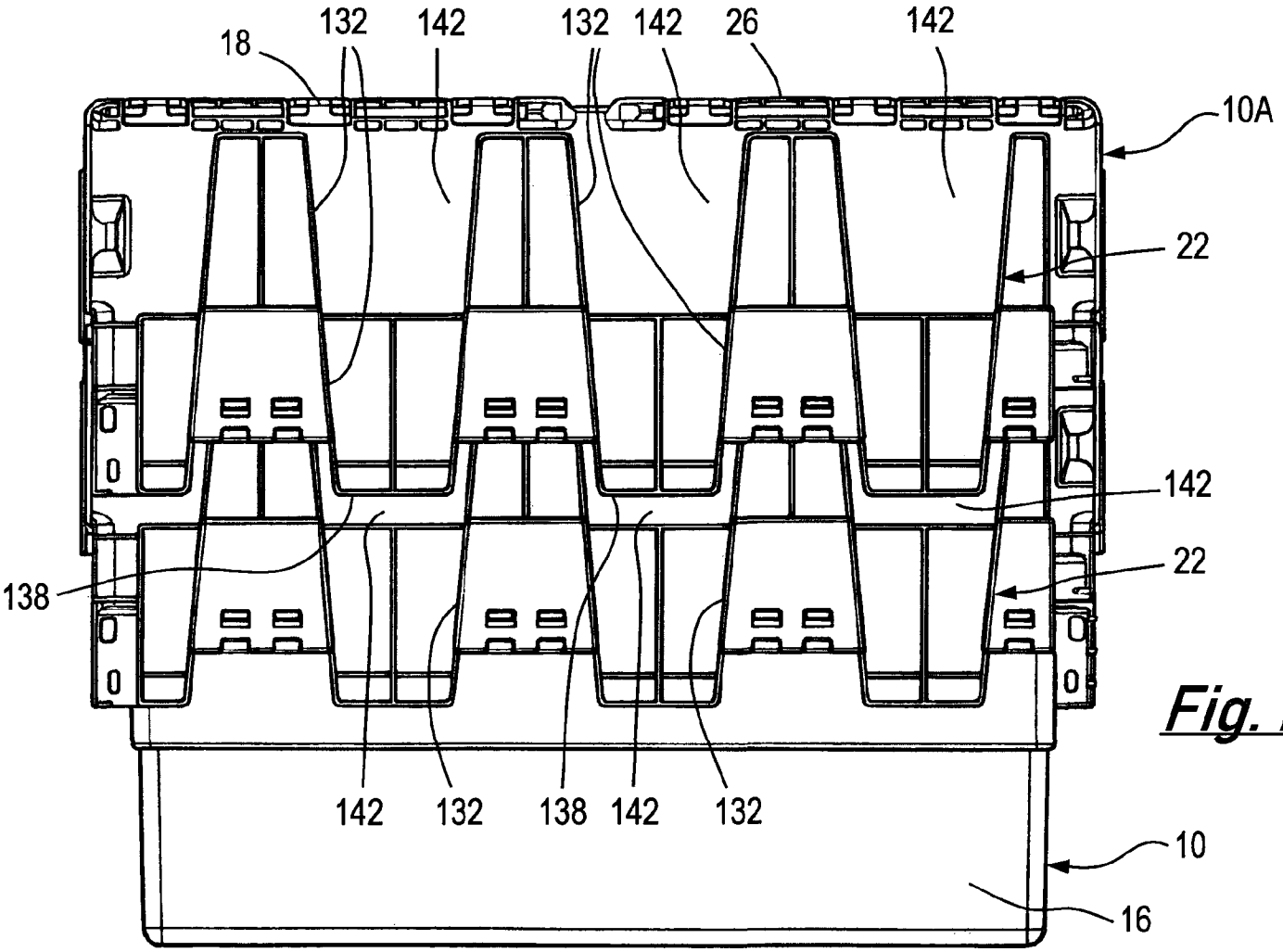
FIG. 13 is a side view of a container arrangement.
Figure 14:
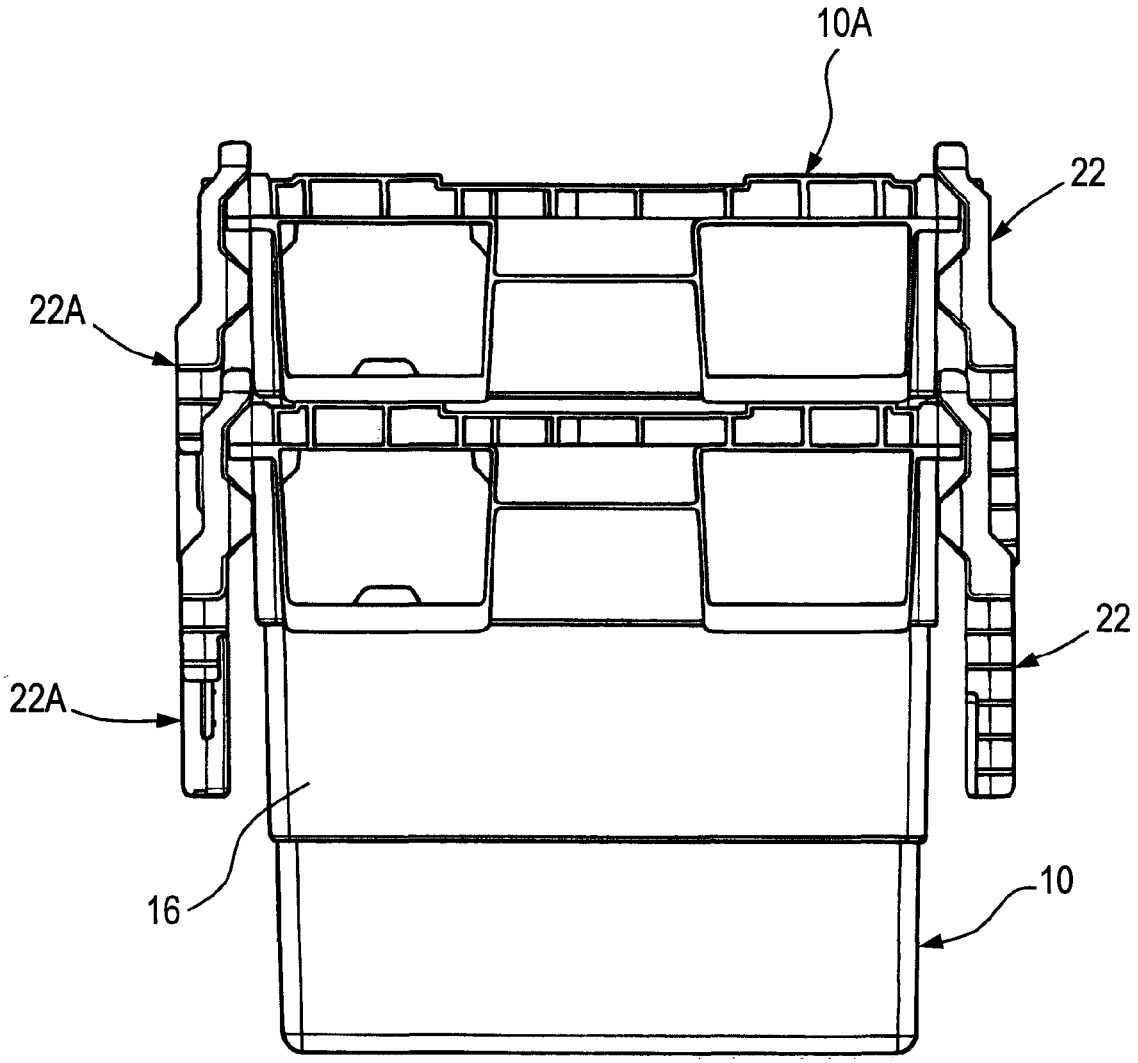
FIG. 14 is an end view of a container arrangement.

Two nesting containers, namely a lower container 10, and an upper container 10A, are shown in FIGS. 13 and 14. The lids 22, 22A of the containers 10, 10A are in their open positions.

As can be seen from FIGS. 13 and 14, the lids 22, 22A hang down from the upper edges of the containers 10, 10A in the open positions of the lids 22, 22A.

In the open positions of the lids 22, 22A shown in FIGS. 13 and 14, the first projecting portions 138 of the lid 22 of the upper container 10A is received in the further recess 142 of the lid 22 of the lower container 10.

The second projecting portions 140 of the lids 22A of the upper container 10A are received in the further recesses 142 defined by the lid 22A of the lower container 10, but this is not visible in the drawings.

The receiving of the projecting portions 138 and 140 in the further recesses 142 has the effect, as shown in FIG. 14 of minimising the extent to which the lids 22, 22A splay outwardly from the walls 16, thereby minimising the required storage space for each array of nested containers.

There is thus described a lid arrangement defining first and second recesses 136, 134 and first and second projecting portions 138, 140 that increase the strength of the lids 22, 22A when the lids are in their closed positions, and which, by virtue of the further recesses 142 allows the containers to be nested occupying minimal space.

Various modifications can be made without departing from the scope of the invention.

The invention claimed is:

1. A lid arrangement comprising:

first and second lids for use in a container comprising a wall arrangement, each lid being movable between open and closed positions;

each lid comprises opposite free and hinged edges, and a plurality of rib formations extending transverse to the aforesaid edges;

wherein when the first and second lids are in the closed positions, the rib formations of the first lid overlap the rib formations of the second lid at respective free edges, the free edge of each of the first and second lids overlap each other when the lids are in the closed positions, and adjacent rib formations of the first lid provide a first projecting portion at the free edge of the first lid, and adjacent rib formations of the second lid provide a second projecting portion at the free edge of the second lid;

wherein the rib formations extend obliquely from the hinged edge, and the rib formations extend substantially wholly across the first and second lids to respective first and second projecting portions, and when the first and second lids are in the closed positions, each rib formation of the first lid extends parallel to, and alongside, a corresponding rib formation of the second lid to provide a line of support that extends across the lid arrangement from the hinged edge of the first lid to the hinged edge of the second lid.

2. A lid arrangement according to claim 1, wherein adjacent rib formations of the first lid define therebetween a first recess extending from the free edge of the first lid, and adjacent rib formations of the second lid define therebetween a second recess extending from the free edge of the second lid.

3. A lid arrangement according to claim 2, wherein the first projecting portion provided by the first lid is received in the second recess of the second lid when the lids are in their closed positions, and the second projecting portion provided by the second lid is received by the first recess of the first lid when the lids are in their closed positions.

4. A lid arrangement according to claim 1, wherein:

a each lid has opposite side edges and a hinge portion arranged between the edges; and a hinge pin;

the hinge portion comprising a hinge member through which the hinge pin extends;

the hinge pin comprising an elongate member having opposite ends, and an end stop portion extending radially outwardly from one of said ends;

wherein the end stop portion is disposed in the hinge portion and the elongate member extends from the end portion through the hinge member towards the free edge of the lid.

5. A container assembly comprising a container and a lid arrangement thereon, the lid arrangement being as claimed in claim 4, wherein the container comprises an upstanding wall and a hinge arrangement on the wall, the lid arrangement being attached to the upstanding wall at the hinge arrangement, and wherein the hinge arrangement comprises a hinge element aligned with the hinge member of the hinge portion, the hinge pin extending through the hinge element to secure the lid to the container.

6. A lid arrangement comprising:

first and second lids for use in a container comprising a wall arrangement, each lid being movable between open and closed positions;

wherein each lid comprises a hinged edge to attach the lid to the wall arrangement, a free edge opposite the hinged edge, and a plurality of rib formations extending transverse to the hinged and free edges;

wherein adjacent rib formations of the first lid define therebetween a first recess extending from the free edge of the first lid, and adjacent rib formations of the second lid define therebetween a second recess extending from the free edge of the second lid;

wherein adjacent rib formations of the first lid provide a first projecting portion at the free edge of the first lid, and adjacent rib formations of the second lid provide a second projecting portion at the free edge of the second lid;

wherein the rib formations extend obliquely from the hinged edge, and the rib formations extend across respective lids to the projecting portions substantially wholly across respective lids; and wherein the first projecting portion provided by the first lid is received in the second recess of the second lid when the lids are in their closed positions, and the second projecting portion provided by the second lid is received by the first recess of the first lid when the lids are in their closed positions.

7. A lid arrangement according to claim 6, wherein adjacent rib formations of each of the first and second lids define a respective further recess therebetween, said further recess extending from the hinged edge, the rib formations defining the further recesses converging towards each other from the hinged edge.

8. A lid arrangement according to claim 7, wherein the rib formations provide the first and second projecting portions to define the further recesses, and the further recess of each lid is aligned with the first or second projecting portion of the respective lid.

9. A lid arrangement according to claim 7, wherein when the first and second lids are in the open positions, the further recess of each of the first and second lids receive a projecting portion of a lid of another container nested in the first mentioned container.

10. A container arrangement comprising:

first and second containers, each of the first and second containers having a lid and a wall arrangement, each lid being movable between open and closed positions;

wherein the lids of the first and second containers have a hinged edge to attach the lids to respective wall arrangement, and a free edge opposite the hinged edge;

wherein adjacent rib formations define a recess therebetween extending from the hinged edge;

wherein adjacent rib formations of the each lid provide a projecting portion at the free edge of respective lid; and wherein when the lids are in the open position, and the second container is nested within the first container, the projecting portion of the lid of the second projection is received in the recess defined between the rib formations of the lid of the first container.

11. A container arrangement according to claim 10, wherein each of the first and second containers comprises first and second lids for use in a container comprising a wall arrangement, each lid being movable between open and closed positions, and wherein each lid comprises a hinged edge to attach the lid to the wall arrangement, a free edge opposite the hinged edge, and a plurality of rib formations extending transverse to the hinged and free edges.

12. A container arrangement according to claim 10, wherein the rib formations extend obliquely from the hinged edge across the respective lids to the projecting portions, the rib formations extending substantially wholly across the respective lids.

13. A container arrangement according to claim 10, wherein adjacent rib formations of the first lid define therebetween a first recess extending from the free edge of the first lid; and adjacent rib formations of the second lid define therebetween a second recess extending from the free edge of the second lid; and wherein adjacent rib formations of the first lid provide a first projecting portion at the free edge of the first lid, and adjacent rib formations of the second lid provide a second projecting portion at the free edge of the second lid;

whereby the first projecting portion provided by the first lid is received in the second recess of the second lid when the lids are in their closed positions, and the second projecting portion provided by the second lid is received by the first recess of the first lid when the lids are in their closed positions.

14. A container arrangement according to claim 13, wherein each of the first and second lids comprises a main part, the hinged edge being an edge of the main part, the free edge being another edge of the main part, and the rib formations extending across the main part.

15. A container arrangement according to claim 13, wherein the adjacent rib formations defining the first recess taper towards each other from the free edge of the first lid, and the adjacent rib formations defining the second recess taper towards each other from the free edge of the second lid.

16. A container arrangement according to claim 13, wherein the first projecting portion extends outwardly from the free edge of the first lid, the adjacent rib formations providing the first projecting portion taper towards each other outwardly from the free edge of the first lid, and wherein the second projecting portion extends outwardly from the free edge of the second lid, the adjacent rib formations providing the second projecting portion taper towards each other outwardly from the free edge of the second lid.

17. A container arrangement according to claim 13, wherein when the first and second lids are in the closed positions, the rib formations of the first lid overlap the rib formations of the second lid, and each rib formation of the first lid extends parallel to, and alongside, a corresponding rib formation of the second lid to provide a line of support that extends across the lid arrangement from the, hinged edge of the first lid to the hinged edge of the second lid.

18. A lid arrangement comprising:

first and second lids for use in a container comprising a wall arrangement, each lid being movable between open and closed positions;

each lid comprises opposite free and hinged edges, and a plurality of rib formations extending transverse to the aforesaid edges;

wherein when the first and second lids are in the closed positions, the rib formations of the first lid overlap the rib formations of the second lid at respective free edges;

the free edge of each of the first and second lids overlap each other when the lids are in the closed positions, and adjacent rib formations of the first lid provide a first projecting portion at the free edge of the first lid, and adjacent rib formations of the second lid provide a second projecting portion at the free edge of the second lid;

wherein the rib formations extend obliquely from the hinged edge, and the rib formations extend substantially wholly across the first and second lids to respective first and second projecting portions, and when the first and second lids are in the closed positions, each rib formation of the first lid extending parallel to, and alongside, a corresponding rib formation of the second lid to provide a line of support that extends across the lid arrangement from the hinged edge of the first lid to the hinged edge of the second lid;

each lid having opposite side edges and a hinge portion arranged between the edges;

and each lid further including a hinge pin;

the hinge portion comprising a hinge member through which the hinge pin extends;

the hinge pin comprising an elongate member having opposite ends, and an end stop portion extending radially outwardly from one of said ends;

wherein the end stop portion is disposed in the hinge portion and the elongate member extends from the end portion through the hinge member towards one of the side edges of the lid.

* * * * *